US005579977A

United States Patent [19]

Yang

[11] Patent Number: 5,579,977

[45] Date of Patent: Dec. 3, 1996

[54] ADJUSTING AND POSITIONING MECHANISM FOR NAILING GUNS

[76] Inventor: Peter Yang, No. 206-19, Sec. 1, Kuo Kuang Road, Ta Li City, Taichung Hsien, Taiwan

[21] Appl. No.: 586,530

[22] Filed: Jan. 16, 1996

[51] Int. Cl.[6] ..... B25C 1/04

[52] U.S. Cl. ..... 227/142; 227/8

[58] Field of Search ..... 227/8, 142

[56] References Cited

U.S. PATENT DOCUMENTS

| | | | |
|---|---|---|---|
| 4,821,937 | 4/1989 | Rafferty | 227/142 |
| 5,197,646 | 3/1993 | Nikolich | 227/8 |
| 5,219,110 | 6/1993 | Mukoyama | 227/8 |
| 5,261,587 | 11/1993 | Robinson | 227/142 |
| 5,385,286 | 1/1995 | Johnson, Jr. | 227/8 |

*Primary Examiner*—Scott A. Smith
*Attorney, Agent, or Firm*—Donald C. Casey

[57] ABSTRACT

An adjusting and positioning mechanism for nailing guns includes a safety rod with a threaded section, an adjusting block having an annular slot in one end thereof for accommodating a spring, a sleeve having a flange at one end thereof and a hole for receiving the safety rod, and a safety plate provided with shoulder portions at one end thereof. The flange of the sleeve is provided with a plurality of projections for fitting into corresponding grooves radially distributed in an end surface of the adjusting block to prevent the adjusting block from turning caused by the shock generated during the nail driving operation so as to ensure the stability of the safety rod.

1 Claim, 2 Drawing Sheets

ADJUSTING AND POSITIONING MECHANISM FOR NAILING GUNS

BACKGROUND OF THE INVENTION (a) Field of the Invention:

The present invention relates generally to an adjusting and positioning mechanism, and more particularly to an adjusting and positioning mechanism for nailing guns to ensure that an adjusting block thereof may be securely positioned in place to prevent a safety rod from displacement during nail driving operation.

(b) Description of the Prior Art

In U.S. Ser. No. 08/491,049 filed by the inventor of the present invention, an adjusting mechanism for nailing guns is described. The mechanism disclosed therein comprises a toothed adjusting block screwably locked with a safety plate to achieve the object of adjusting the position of the safety plate according to the drive depth. However, the shock generated during the driving operation may cause the adjusting block to turn on its own, causing the safety plate to displace forwardly or rearwardly, which will affect the precision of the drive depth. It is hence necessary to adjust the position of the safety rod after several driving operations.

SUMMARY OF THE INVENTION

Accordingly, a primary object of the present invention is to provide an adjusting and positioning mechanism for nailing guns, in which a sleeve is provided with projections while an adjusting block is provided with corresponding grooves for engaging the projections so as to ensure that the adjusting block may not be turned freely during the nailing operation.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
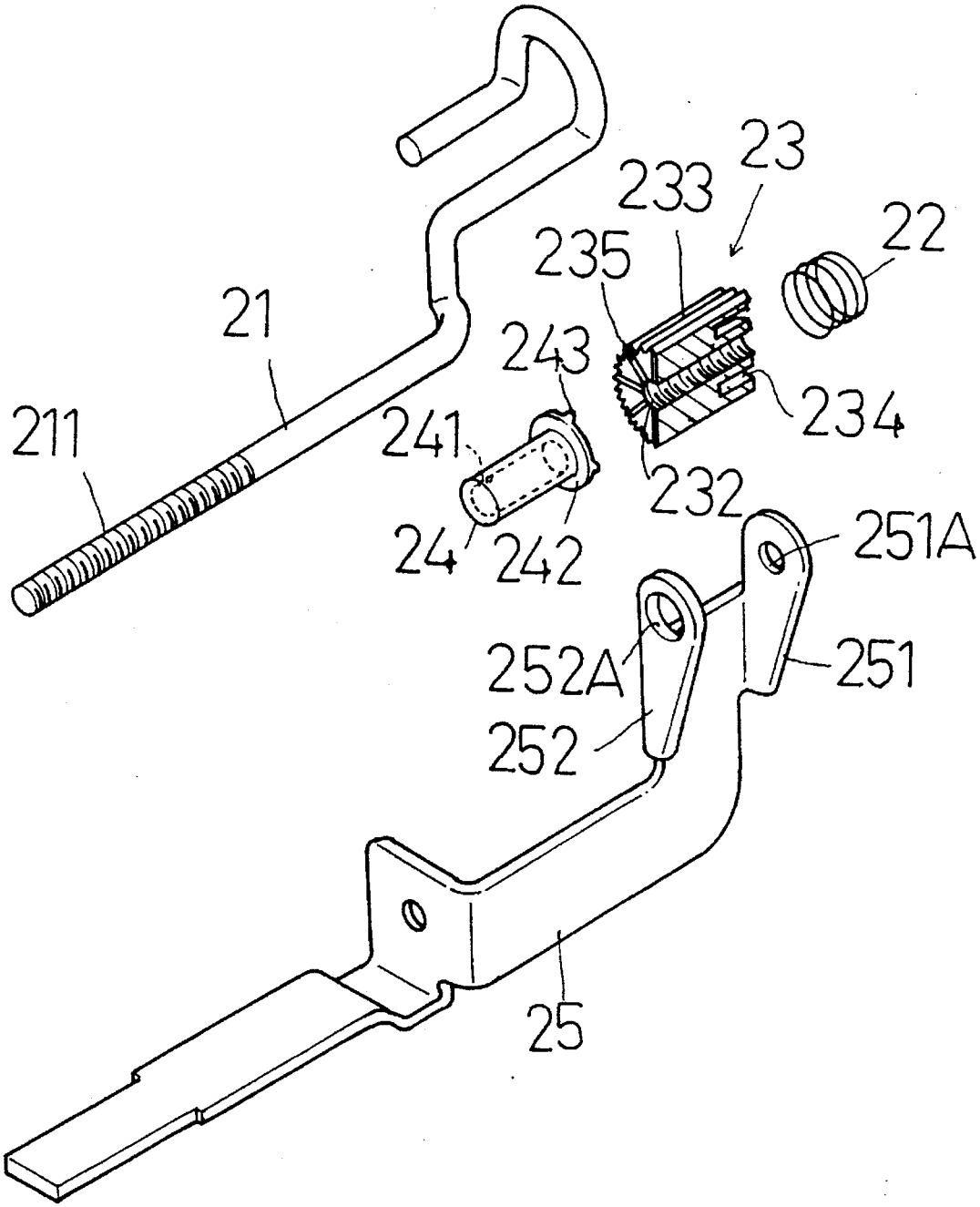
FIG. 1 is a perspective exploded view of a preferred embodiment of the present invention.
Figure 2:
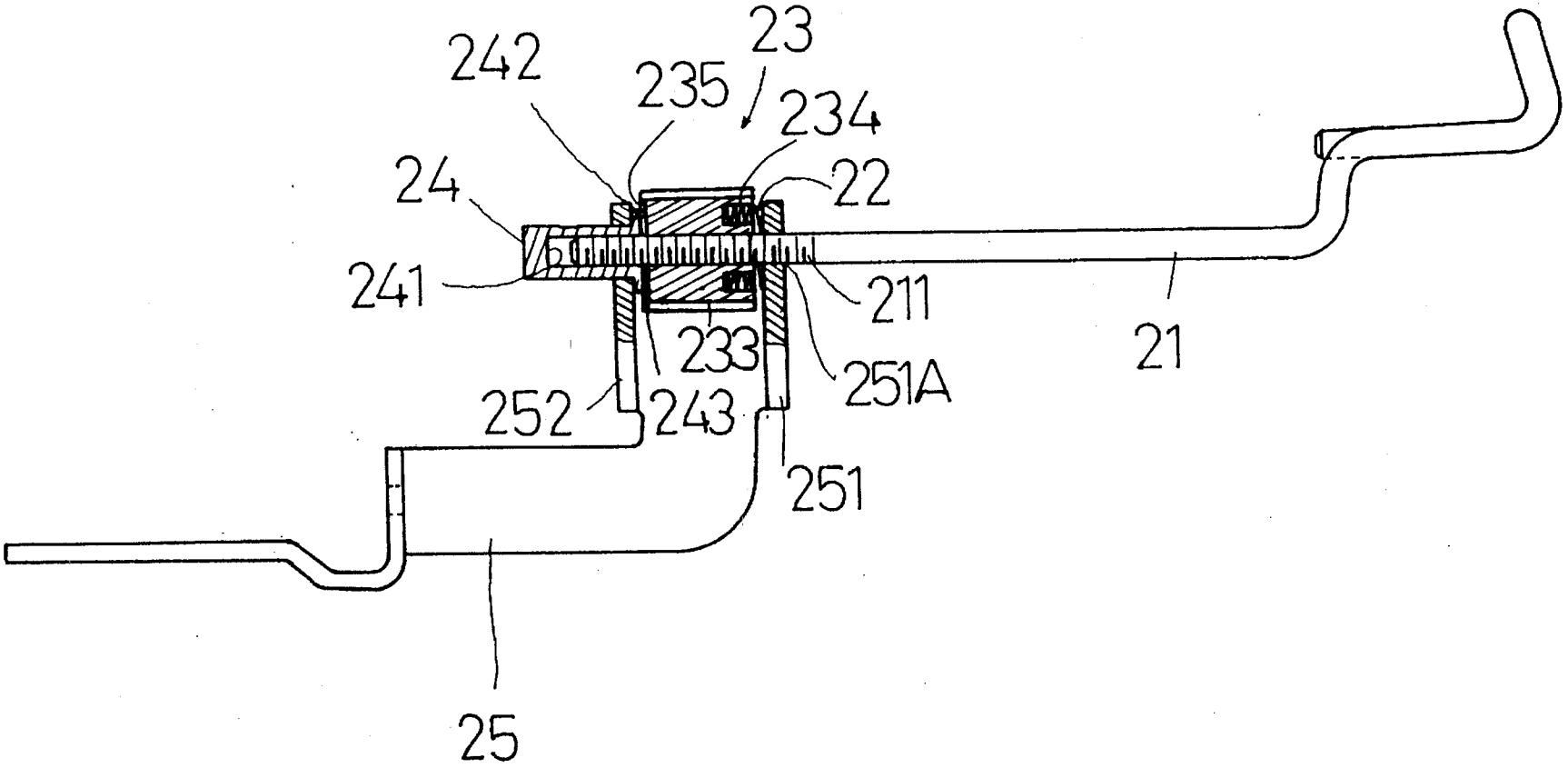
FIG. 2 shows the present invention in an assembled state.

With reference to the drawings, a preferred embodiment of the adjusting and positioning mechanism according to the present invention comprises a safety safety rod 21, a spring 22, an adjusting block 23, a sleeve 24 and a safety plate 25. As shown in FIG. 1, the adjusting block 23 is a cylindrical structure provided with teeth 233 around its circumferential surface to faciliate turning and having an annular slot 234 in one end thereof for accommodating the spring 22 and a threaded through hole 232 for receiving a threaded section 211 of the safety rod 21. The sleeve 24 has an internal hole 241 for receiving the safety rod 21 and a flange 242 for urging against a front shoulder 251 and a rear shoulder 252 of the safety plate 25 projecting from a rear end portion of the safety plate 25. The front and rear shoulders 251, 252 respectively have holes 251A and 252A respectively formed at suitable positions thereof. These holes 251A and 252A are different in size and may receive and position the safety rod 21, the spring 22, the adjusting block 23 and the sleeve 24.

A feature of the present invention resides in the arrangement of male fastening means on the sleeve 24 and female fastening means on the adjusting block 23. With reference to the drawings, the adjusting block 23 has one end surface thereof provided with a plurality of grooves 235 distributed in a radial manner, while the sleeve 24 is provided with a suitable number of projections 242 on an upper surface of the flange 242 for matching the grooves 235. In FIG. 1, there are shown four projections 24 on the flange 242 and eight grooves 235 in the adjusting block 23. After assembly, the projections 243 will fit into the corresponding grooves 235 for the purposes of securing and positioning the adjusting block 23, while the sleeve 24 is securely riveted to the hole 252A of the rear shoulder 252 of the safety plate 25. Since the spring 22 is accommodated within the annular slot 234 of the adjusting block 23 with one end thereof urging against the front shoulder 251 of the safety plate 25, and the adjusting block 23 is located at a suitable distance from the front shoulder 251, when the safety rod 21 is being adjusted by turning the adjusting block 23, the clearance between the spring 22 and the front shoulder 251 may ensure that the contact between the projections 243 and the grooves 235 may not be affected and that they may remain in an engaging relationship. By means of this arrangement, the adjusting block 23 may be prevented from free turning and, hence, the safety. rod 21 may be inhibited from displacement caused by the shock generated during driving.

The arrangement of the annular slot 234 in one end of the adjusting block 23 for accommodating the spring 22 is to enhance the stability of the safety rod 21 by means of providing a longer threaded through hole 232.

Although the present invention has been illustrated and described with reference to the preferred embodiment thereof, it should be understood that it is in no way limited to the details of such embodiment but is capable of numerous modifications within the scope of the appended claims.

What is claimed is:

1. An adjusting and positioning mechanism for nailing guns, said mechanism comprising:

a safety rod having a threaded rear end section; a spring;

an adjusting block having an annular slot in one end thereof for accommodating said spring and a threaded through hole for receiving said safety rod, said adjusting block having a toothed outer surface;

a sleeve having a flange at one end thereof and an internal hole for receiving receiving said rear end section of said safety rod; and a safety plate having a front shoulder and a rear shoulder, said rear shoulder being provided with a hole for receiving said sleeve with said flange thereof urging against a rim of said hole, said front shoulder also having a hole for insertion of said safety rod therethrough such that said adjusting block with said spring may be located intermediate said front and rear shoulders, wherein said flange of said sleeve is provided with a plurality of projections and said adjusting block is provided with a plurality of grooves radially distributed in an end surface thereof for matching said projections, said projections being fitted into said grooves to ensure the stability of said safety rod during nail driving operation.

* * * * *